US006016671A

United States Patent [19]

Beldham

[11] Patent Number: 6,016,671

[45] Date of Patent: Jan. 25, 2000

[54] SAFETY CIRCUIT FOR COMMERCIAL WASHING MACHINES

[76] Inventor: Paul M. Beldham, 26182 Palmetto Pl., Mission Viejo, Calif. 92691

[21] Appl. No.: 08/806,281

[22] Filed: Feb. 25, 1997

[51] Int. Cl.[7] ..... D06F 39/02

[52] U.S. Cl. ..... 68/12.18; 68/12.27; 68/17 R; 68/207; 137/566; 222/144.5; 222/651

[58] Field of Search ..... 68/12.17, 12.18, 68/12.27, 17 R, 207; 134/58 D, 99.2; 222/144.5, 651; 137/566, 624.11

[56] References Cited

U.S. PATENT DOCUMENTS 4,213,313 7/1980 Kiefer et al. ..... 134/58 D X
5,208,930 5/1993 Chabard ..... 68/12.18 X

*Primary Examiner*—Philip R. Coe
*Attorney, Agent, or Firm*—Harry G. Weissenberger

[57] ABSTRACT

A safety circuit for washing machines prevents an accidental simultaneous feed of bleach and sour due to a malfunction of the machine's controller, by interposing a normally open contact and a normally closed contact of a relay, respectively, in the sour pump power line and the bleach pump power line. The coil of the relay is powered by the controller's power output for the pump in whose power circuit the normally open contact is located.

19 Claims, 1 Drawing Sheet

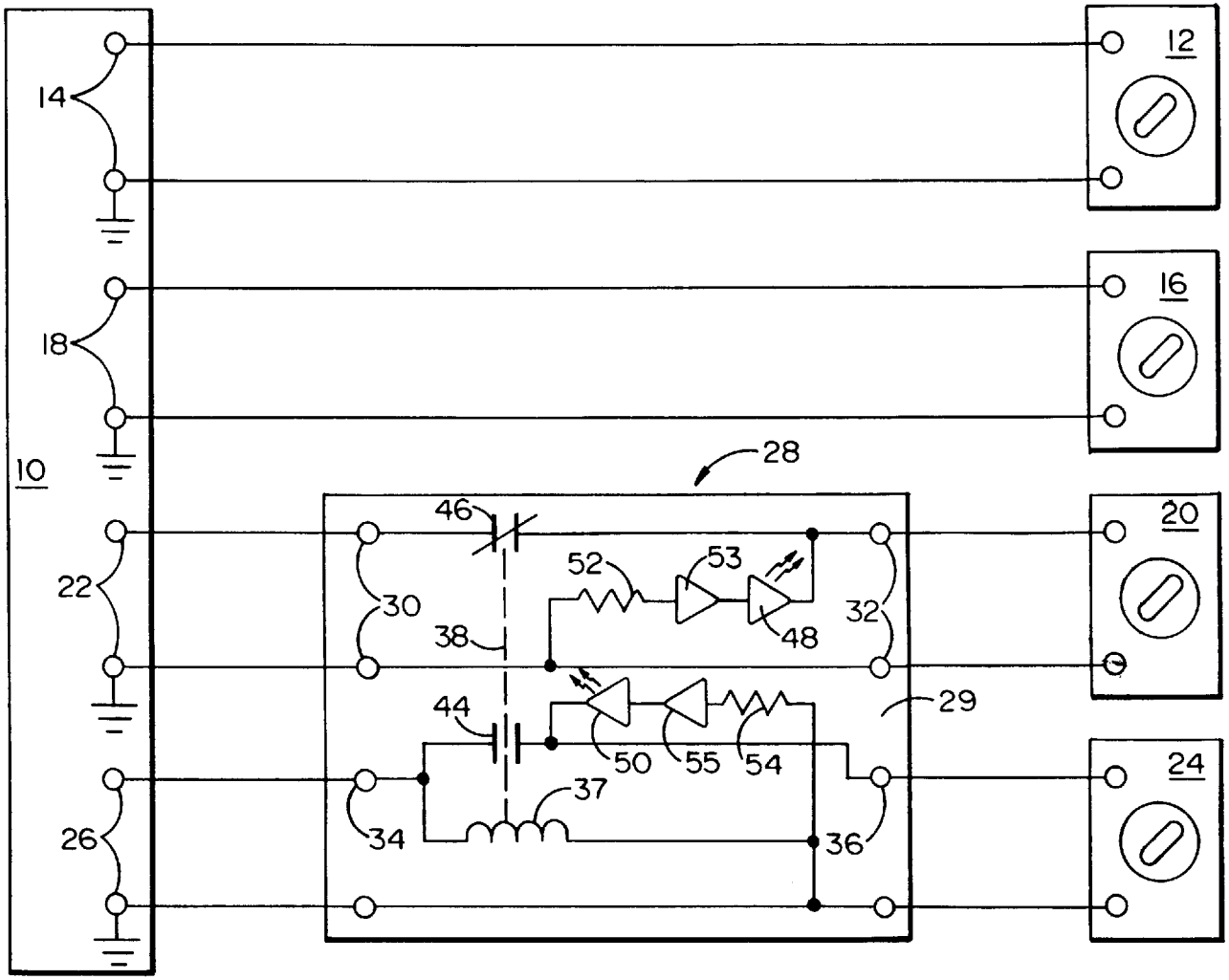
12
16
20
24
29
28
32
36
48
54
53
55
52
50
37
46
38
44
30
34
14
18
22
26
10

SAFETY CIRCUIT FOR COMMERCIAL WASHING MACHINES

FIELD OF THE INVENTION

This invention relates to safety devices for preventing the accidental mixture of dangerous chemical reagents, and more particularly to a safety circuit for preventing the accidental mixture of chlorine bleach and acid in computer-controlled commercial washing machines.

BACKGROUND OF THE INVENTION

Large commercial washing machines are in wide use in a variety of commercial, industrial and institutional settings. These machines typically use chemicals such as detergent, softener, sour (i.e. acid for maintaining a proper pH level in the wash water) and a chlorine-based bleach such as sodium hypochlorite. In the normal functioning of the machine, a sensor-and-timer-driven microprocessor typically controls a group of separate pumps which add these chemicals to the wash water at the proper time and in the proper quantities for optimum washing action.

One of the functions of the microprocessor is to prevent the addition of sour and bleach to the water simultaneously, i.e. before one of these components has become sufficiently diluted to prevent an adverse reaction with the other. Because the undiluted mixing of sour and bleach causes the release of toxic chlorine gas, the proper functioning of the microprocessor and pump circuitry in this respect is vital.

A number of solutions have been proposed to guarantee the reliability of the dispensing control. For example, it has been proposed to provide the microprocessor with redundant or self-checking circuitry; to provide sensors to shut down the pumps if chlorine gas is detected; and to introduce the chemicals into the water at different locations. None of these approaches have, however, been satisfactory and economically practical.

The fact remains that with many such machines in use, the eventual failure of the pump control circuitry in one of them is a statistical near-certainty. Indeed, such failures with potentially catastrophic consequences have already occurred. Consequently, a need exists in the commercial washing machine industry for an inexpensive fail-safe device which can be incorporated into the controller or easily installed as an aftermarket device, and which makes it physically impossible for the sour and bleach pumps to be energized at the same time.

SUMMARY OF THE INVENTION

The circuit of this invention fills the above-described need by interposing between the controller and the sour and bleach pumps a nonbridging (i.e. break-before-make) double-throw, preferably double-pole relay. The relay coil is connected, e.g. to the bleach pump driver output of the controller; the normally open contacts of one pole of the relay are connected between the bleach pump driver output of the controller and the bleach pump; and the normally closed contacts of the other pole of the relay are connected between the sour pump driver output of the controller and the sour pump.

BRIEF DESCRIPTION OF THE DRAWINGS

The single FIGURE of the drawing is a circuit diagram of the safety device of this invention in conjunction with the controller and pumps of a washing machine.

DESCRIPTION OF THE PREFERRED EMBODIMENT

In the drawing, 10 designates the pump driver output terminal strip of a typical washing machine controller. A detergent pump 12 is normally connected to controller terminals 14; a softener pump 16 is normally connected to controller terminals 18; a sour pump 20 is normally connected to controller terminals 22; and a bleach pump 24 is normally connected to controller terminals 26.

In accordance with the invention, a safety circuit 28, which may be disposed on a mounting board 29, is interposed in the lines which connect controller terminals 22 to sour pump 20, and controller terminals 26 to bleach pump 24. For this purpose, controller terminals 22 are connected to safety circuit terminals 30 while the sour pump 20 is connected to safety circuit terminals 32. Controller terminals 26 are connected to safety circuit terminals 34, while the bleach pump 24 is connected to safety circuit terminals 36. The coil 37 of a double-pole, double-throw nonbridging relay 38 is connected in the safety circuit 28 across terminals 34.

The normally open contacts 44 of one pole of the relay 38 are connected in series with one of the lines (preferably the hot line rather than the ground line to prevent defeating of the safety circuit 28 by grounding of the pumps 20, 24) connecting terminals 34 to terminals 36. The normally closed contacts 46 of the other pole of relay 38 are connected in series with one of the lines (again preferably the hot line) connecting terminals 30 to terminals 32. Light-emitting diodes 48, 50 in series with appropriate resistors 52, 54 and rectifying diodes 53, 55 may be connected across terminals 32 and 36, respectively, to indicate which one of the pumps 20, 24 is powered at any given time. This allows malfunctions to be readily recognized and monitored.

The fact that relay 38 is a nonbridging (i.e. break-before-make) relay assures that the contacts 44 and 46 can never be closed at the same time, and consequently that the pumps 20, 24 can never be powered at the same time. Because the pumps 20, 24 are typically rotary pumps that deliver a predetermined quantity of chemical per revolution, no chemical can escape from a pump 20 or 24 when it has no drive power.

In the event of a failure of the relay 38, no bleach will be delivered, but the sour delivery will remain unaffected. If a controller failure keeps the board terminals 26 (or both the board terminals 22 and 26) continuously energized, or if the relay 38 jams in the energized position, the sour pump 20 is effectively disconnected for the duration of the problem; and if the controller failure keeps only the board terminals 22 continuously energized, the sour pump 20 will operate whenever the bleach pump 24 is shut off. The operation of the detergent pump 12 and the softener pump 16 is not affected by the safety circuit 28.

It will thus be seen that the safety circuit 28 is a simple, readily retrofittable, fail-safe safety device which can be either incorporated in the controller output, or retrofitted into existing installations. While the circuit 28 may not prevent equipment malfunctions that result in chemical damage to the machine or the laundry, it nevertheless prevents the serious consequences of a malfunction that can cause generation of toxic chlorine gas.

It is understood that the exemplary safety circuit for commercial washing machines described herein and shown in the drawings represents only a presently preferred embodiment of the invention. Indeed, various modifications and additions may be made to such embodiment without departing from the spirit and scope of the invention. Thus, other modifications and additions may be obvious to those skilled in the art and may be implemented to adapt the present invention for use in a variety of different applications.

I claim:

1. A safety circuit for a machine having first and second pumps for respectively supplying incompatible chemicals to said machine, said pumps being activated at different times by selectively connecting a power source to first and second electric lines connected respectively to said first and second pumps, said safety circuit comprising:

a) a relay interposed in the connections between said lines and said pumps, said relay having a coil, a set of normally open contacts, and a set of normally closed contacts;

b) said normally open contacts being connected in series with one of said lines; said normally closed contacts being connected in series with the other of said lines; and said coil being connected across said one of said lines between said power source and said normally open contacts.

2. The circuit of claim 1, in which said relay is a nonbridging relay.

3. The circuit of claim 1, in which said normally open contacts are disposed on a different pole of said relay than said normally closed contacts.

4. The circuit of claim 1, in which said contacts are disposed in the hot lead of their respective line.

5. The circuit of claim 1, in which said pumps are sour and bleach pumps, respectively.

6. The circuit of claim 5, in which said coil is connected across the line powering said bleach pump.

7. The circuit of claim 5, in which said normally open contacts are disposed in the line powering said bleach pump.

8. A retrofittable safety circuit for a washing machine having first and second pumps for respectively supplying incompatible chemicals to said washing machine, said pumps being activated at different times by a controller including, first and second sets of controller terminals connectable, respectively, to said first and second pumps, and powered selectively by said controller, said safety circuit comprising:

a) a mounting board;

b) first, second, third and fourth sets of circuit terminals carried by said board, said first and second sets of circuit terminals being arranged to be connected to said first and second sets, respectively, of said controller terminals, and said third and fourth sets of circuit terminals being arranged to be connected to said first and second pumps, respectively;

c) a first pair of leads connecting said first set of circuit terminals to said third set of circuit terminals;

d) a second pair of leads connecting said second set of circuit terminals to said fourth set of circuit terminals; and e) a relay carried by said board, said relay having a coil, a set of normally closed contacts, and a set of normally open contacts;

f) said normally closed contacts being connected in series with one of said first pair of leads, said normally open contacts being connected in series with one of said second pair of leads, and said coil being connected across said first set of circuit terminals.

9. The circuit of claim 8, in which said relay is a nonbridging relay.

10. The circuit of claim 8, in which said normally open contacts are disposed on a different pole of said relay than said normally closed contacts.

11. The circuit of claim 8, in which said contacts are disposed in the hot lead of their respective line.

12. The circuit of claim 8, in which said pumps are sour and bleach pumps, respectively.

13. The circuit of claim 12, in which said coil is connected across the line powering said bleach pump.

14. The circuit of claim 12, in which said normally open contacts are disposed in the line powering said bleach pump.

15. The circuit of claim 8, further including light-emitting diodes connected across said third and fourth circuit terminals, respectively, to allow verification of the nonsimultaneous operation of said pumps.

16. The circuit of claim 8, in which said coil is connected in series with a selectively shortable resistor to allow operation of said circuit at different power voltages.

17. A washing machine, comprising:

a) first and second pumps arranged to respectively supply incompatible chemicals to said machine;

b) a controller arranged to nonsimultaneously activate said pumps by selectively connecting a power source to said first and second pumps through electric lines;

c) a relay interposed in said lines connecting said power source and said pumps, said relay having a coil, a set of normally open contacts, and a set of normally closed contacts;

d) said normally open contacts being connected in series with one of said lines; said normally closed contacts being connected in series with the other of said lines; and said coil being connected across said one of said lines between said power source and said normally open contacts.

18. The washing machine of claim 17, in which said first and second pumps are bleach and sour pumps, respectively.

19. The washing machine of claim 18, in which said coil and normally closed contacts are interposed in the line connecting said power source and said bleach pump.

* * * * *